US005949347A

United States Patent [19]

Wu

[11] Patent Number: 5,949,347

[45] Date of Patent: Sep. 7, 1999

[54] LIGHT EMITTING DIODE RETROFITTING LAMPS FOR ILLUMINATED SIGNS

[75] Inventor: Chen H. Wu, Los Altos Hills, Calif.

[73] Assignee: Leotek Electronics Corporation, Taipei, Taiwan

[21] Appl. No.: 08/914,967

[22] Filed: Aug. 20, 1997

Related U.S. Application Data

[60] Provisional application No. 60/025,648, Sep. 11, 1996, and provisional application No. 60/028,366, Oct. 11, 1996.

[51] Int. Cl.[6] ..... G08B 5/22

[52] U.S. Cl. ..... 340/815.45; 340/815.73; 345/82; 362/800; 362/812; 313/318.04; 40/570

[58] Field of Search ..... 340/815.45, 332, 340/907, 815.73; 345/82; 362/800, 812; 313/500, 318.01, 318.04; 40/564, 570, 572

[56] References Cited

U.S. PATENT DOCUMENTS

| | | | |
|---|---|---|---|
| 4,298,869 | 11/1981 | Okuno | 340/782 |
| 4,682,147 | 7/1987 | Bowman | 340/286 R |
| 4,887,074 | 12/1989 | Simon et al. | 340/782 |
| 5,040,320 | 8/1991 | Reidinger | 40/570 |
| 5,388,357 | 2/1995 | Malita | 40/570 |
| 5,410,453 | 4/1995 | Ruskouski | 362/20 |
| 5,416,679 | 5/1995 | Ruskouski et al. | 362/240 |
| 5,428,912 | 7/1995 | Grondal et al. | 40/570 |
| 5,459,955 | 10/1995 | Ruskouski et al. | 40/570 |
| 5,463,280 | 10/1995 | Johnson | 315/187 |
| 5,526,236 | 6/1996 | Burnes et al. | 362/20 |
| 5,655,830 | 8/1997 | Ruskouski | 362/240 |
| 5,688,042 | 11/1997 | Madadi et al. | 362/240 |
| 5,726,535 | 3/1998 | Yan | 315/185 R |
| 5,729,925 | 3/1998 | Prothero | 40/570 |

OTHER PUBLICATIONS

Quantum Lamps, Ameratech R&D Inc. & Leotek Inc. product information sheet, 2 pages, Pub. Feb. 1992.

Maintenance–Free L.E.D. Exit Sign, Leotek Electronics Corporation product information sheet, 2 pages, Pub. 1995.

Leotek Lamps, Leotek Electronics Corporation product information sheet, 2 pages, Pub. Aug. 1996.

Leotek Open Signs, Leotek Electronics Corporation product information sheet, 2 pages, Pub. 1996.

Astralite 2000, Astralite product information sheet, 2 pages, Pub.1994.

T6.5 Ultra Life, Halco Lighting Corporation product information sheet, 1 page, Pub. 1995.

Redhead LED Exit Lamp, TCP product information sheet, 1 page, Pub. Nov., 1995.

E–Z Lamp, Isolite Corp. product information sheet, 2 pages, Pub. 1995.

Exbrite Exit Retrofit, Conservalite Technologies, Inc. product information sheet, 1 page, Pub. Apr. 5, 1996.

Bright Idea, Standard Enterprises Inc. product information sheet, 2 pages, Pub. Mar. 1, 1996.

Universal T Lamp, Area Lighting Research, Inc. product information sheet, 2 pages, Pub. Apr., 1996.

Wattman LED Exit Retrofit Lamp, Standard Enterprises Inc. product information sheet, 2 pages, Pub. 1995.

*Primary Examiner*—Daniel J. Wu
*Assistant Examiner*—Sihong Huang
*Attorney, Agent, or Firm*—Limbach & Limbach L.L.P.

[57] ABSTRACT

Retrofitting lamps using Light-Emitting Diodes (LEDs) as the illumination source. The lamps are fitted with any one of the common incandescent lamp bases for use as retrofit lamps for illuminated EXIT signs and the like. The LED lamps are electrically powered with a current limiting device to allow LED to operate at a desired current level. The LEDs are arranged on a shaped frame so that they are aimed in directions to provide bright and uniform illumination over an area of the face of the sign that is wider and longer than the width and the length of the lamps.

23 Claims, 10 Drawing Sheets

LIGHT EMITTING DIODE RETROFITTING LAMPS FOR ILLUMINATED SIGNS

This application claims benefit of U.S. Provisional Application No. 60/025,648, filed Sep. 11, 1996, and U.S. Provisional Application No. 60/028,366, filed Oct. 11, 1996.

FIELD OF THE INVENTION

The present invention relates to lamps, and more particularly to light emitting diode (LED) lamps for illuminated signs.

BACKGROUND OF THE INVENTION

Many public, commercial and office buildings have illuminated signs delineating a path to an exit. A common example of such an illuminated sign is the "EXIT" sign 2 illustrated in FIGS. 1 and 2, which has an opaque front face 4 and light transmissive (translucent) indicia 6 such as letters and/or symbols thereon. Standard electrical lamp sockets 8 are positioned inside the sign 2 for securing and lighting lamps 10 therein to illuminate the translucent indicia 6. Although the present invention applies to any illuminated sign, this discussion will be limited to the illustrated "EXIT" sign of FIGS. 1 and 2 for simplicity.

Most "EXIT" signs in use today are illuminated by an incandescent or florescent lamp 10 threaded into two internally mounted sockets 8. The translucent letters typically include a filter so that light emanating from the sign has the desired color, such as red or green letters and arrows to indicate exit path locations. These signs can be one sided as shown in FIGS. 1 and 2, or two sided with opposing front and rear faces having translucent indicia thereon.

Conventional illuminated signs have several drawbacks. The standard incandescent or fluorescent lamps used therein have a relatively short life span and consume significant amounts of energy. These problems are of special concern because most "EXIT" signs are continuously illuminated. Another drawback with incandescent or fluorescent lamps is that the translucent portions of the illuminated sign are not uniformly illuminated because the portions of the translucent indicia closer to the lamps are generally brighter than those portions further away.

To reduce electrical cost and increase reliability, Light Emitting Diode (LED) lamps have been developed to replace the conventional incandescent or fluorescent lamps typically used in existing "EXIT" signs. LED lamps consume less energy than convention lamps while exhibiting much longer lifetimes. However, the LED lamp designs used thus far still do not provide sufficiently bright, uniform illumination of the translucent portions of the sign face(s).

For Example, U.S. Pat. No. 5,388,357 discloses LED arrays mounted internally on the interior sign box side using an adhesive, and adapters electrically connecting the lamp sockets to the LED arrays. U.S. Pat. No. 5,459,955 discloses linear array LED lamps having a standard incandescent lamp base for direct replacement into the lamp socket. The resulting illumination over the face of the sign for either of these designs, however, is insufficiently uniform because brighter illumination occurs for those portions of the sign face directly opposing the output of the LEDs.

Other schemes have been developed to produce a more even illumination with LED based lamps, including indirect illumination using a reflector as shown in U.S. Pat. No. 5,428,912, and a plurality of fibers depicting the word "EXIT" in U.S. Pat. No. 5,040,320. These designs, however, are complex, impractical and/or too costly for retrofitting existing "EXIT" signs. Further, these designs still fail to provide sufficiently uniform illumination over the sign face.

There is a need for a simple LED retrofit lamp that conveniently installs into existing "EXIT" signs, and which brightly and uniformly illuminates the translucent indicia on one or more faces of the illuminated sign.

SUMMARY OF THE INVENTION

The present invention solves the aforementioned problems by providing an LED retrofit lamp that has a frame terminating in a lamp base that inserts directly into the lamp socket of an illuminated sign, such as an "EXIT" sign. The frame forms a U-shaped front face upon which a pair of partially opposing LED linear arrays are mounted. Some of the LEDs are adjusted upward, and other are adjusted downward. The partially opposing linear LED arrays evenly and brightly illuminate a portion of an adjacent sign face that is significantly wider and/or longer than the width and length of the lamp.

One aspect of the present invention includes an LED lamp having a lamp base, an elongated lamp frame with a longitudinal axis and a front face, and first and second linear arrays of light emitting diodes mounted on the front face which extend substantially parallel to the longitudinal axis. The first and second linear arrays are mounted to partially face toward or partially face away from each other.

In another aspect of the present invention, an illuminated sign includes a housing with a front display panel that has a first translucent indicia portion, and an LED lamp disposed adjacent the front display panel. The LED lamp includes a lamp base, an elongated lamp frame having a longitudinal axis and a front face, and first and second linear arrays of light emitting diodes mounted on the front face and extending substantially parallel to the longitudinal axis. The first and second linear arrays produce a first light output and are mounted to partially face toward or partially face away from each other. The first and second linear arrays project a majority of the first light output onto the front display panel at non-perpendicular angles relative to the front display panel.

Other objects and features of the present invention will become apparent by a review of the specification, claims and appended figures.

DETAILED DESCRIPTION OF THE PREFERRED EMBODIMENTS

Figure 1:
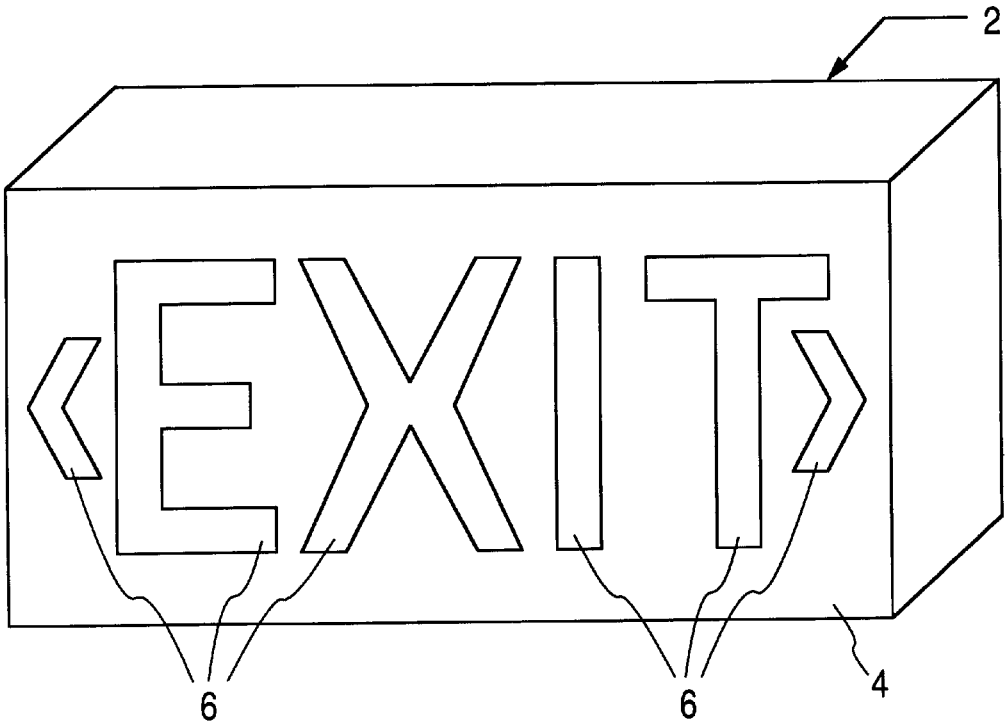
FIG. 1 (PRIOR ART)
FIG. 1 is a front view of a conventional "EXIT" sign.
Figure 2:
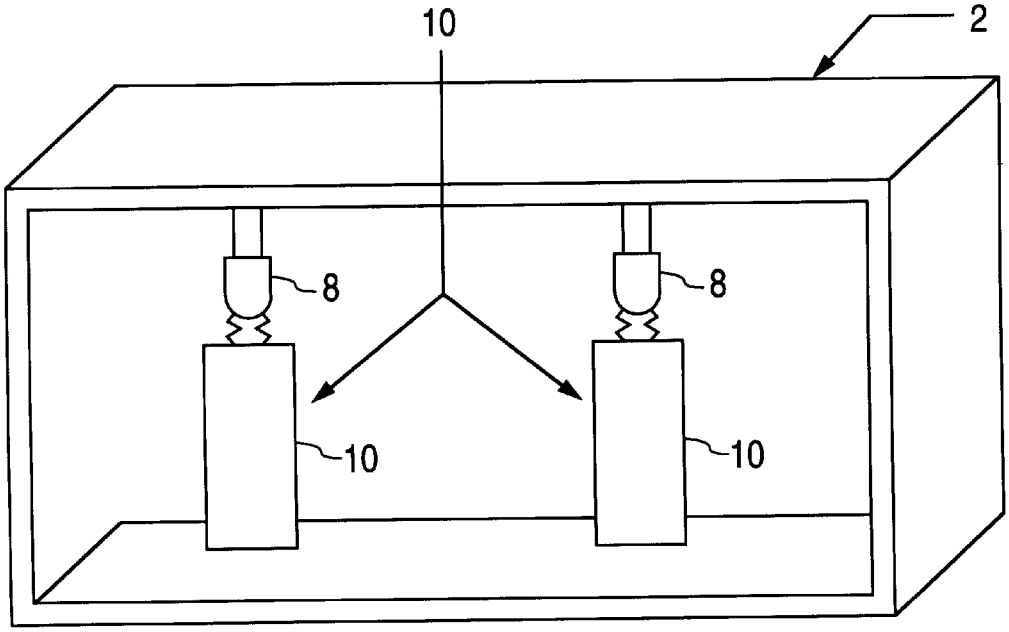
FIG. 2 (PRIOR ART)
FIG. 2 front view of the inside of a conventional "EXIT" sign.
Figure 3A:
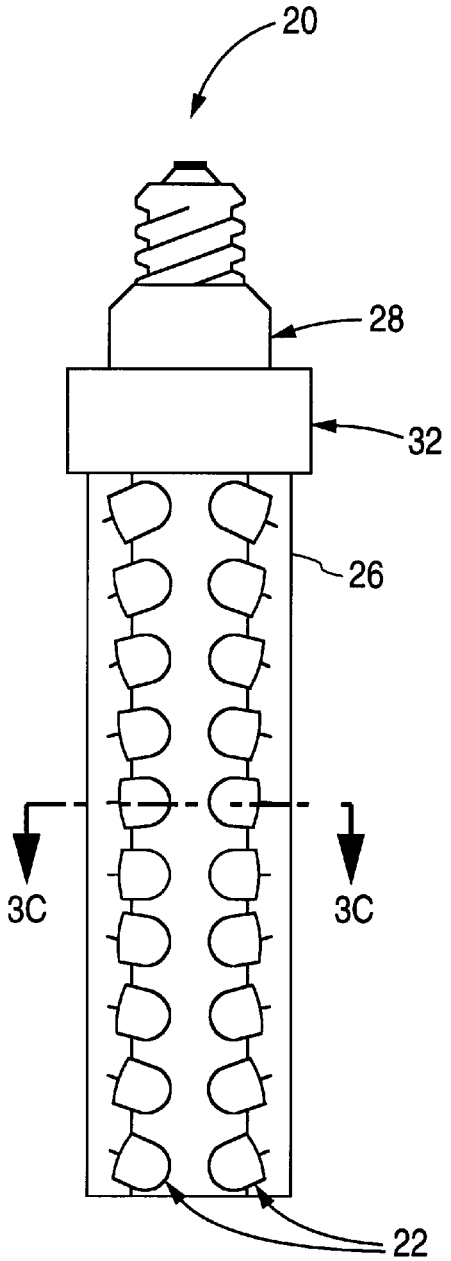
FIG. 3A is a front view of the LED retrofit lamp of the present invention.
Figure 3B:
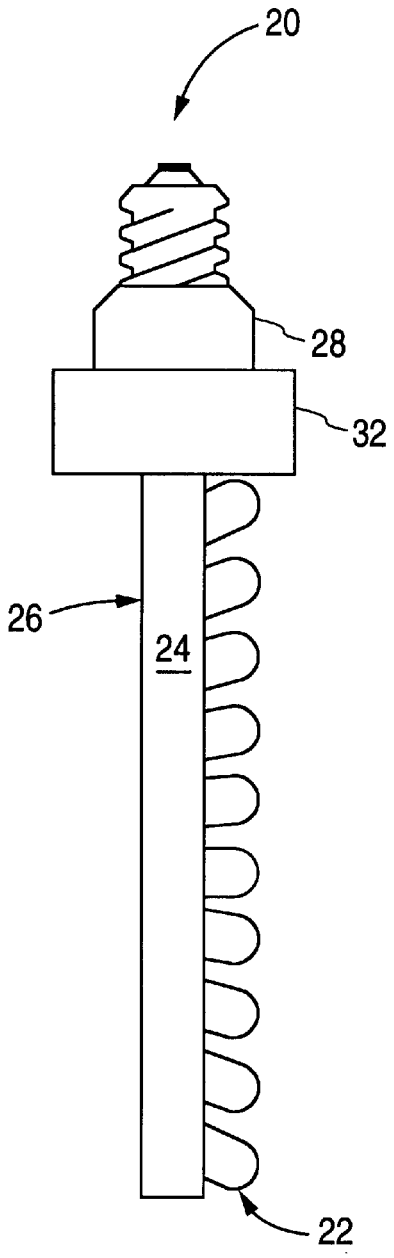
FIG. 3B is a side view of the LED retrofit lamp of the present invention.
Figure 3C:
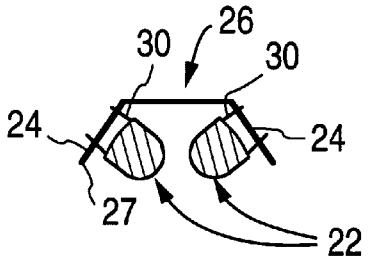
FIG. 3C is a top cross-section view of the LED retrofit lamp of the present invention.

The present invention is an LED lamp that directly inserts into the lamp sockets of existing "EXIT" signs for bright and uniform illumination of the translucent portion(s) of the sign face(s). The LED lamp 20 of the present invention is illustrated in FIGS. 3A, 3B and 3C.

The lamp 20 includes a pair of linear arrays of light emitting diodes (LEDs) 22 preferably mounted on a pair of PC boards 24. The PC boards are connected together to form a lamp frame 26 that defines a U-shaped front face 27 on which the pair of LED arrays are mounted. The LED arrays 22 partially face each other. One end of the frame 26 is attached to a lamp base 28 that screws into a standard lamp socket. A driving circuit (not shown) for the LEDs, composed of rectifiers and capacitors, is arranged either inside the lamp base 28 or on the back side of the frame 26. Driving circuits for LED arrays are well known in the art and are not discussed in detail in this disclosure.

A majority of the light emanating from an LED is generally projected in the direction in which the LED output end is pointing (facing). Therefore, the direction that a linear LED array faces is the direction in which the LED output ends point (in a plane perpendicular to the longitudinal axis of the LED linear array). The U-shape of the front face 27 positions the LED arrays 22 to partially face each other such that the LEDs project a majority of the output light onto the adjacent sign face at non-perpendicular angles. The front surface 27 may be formed from, or coated with, a reflective material. This configuration results in lamp 20 evenly illuminating an area of the adjacent sign face that is significantly wider than the width of the lamp itself.

The LEDs are mounted onto the frame 26 so that they are raised from the front face 27. This allows the leads 30 of the LEDs to be bent to individually adjust the orientation of the LEDs upward or downward (toward and away from lamp base 28, respectively). As illustrated in FIG. 3B, the LEDs in the upper half of each array are bent upwards and the LEDs in the lower half of each array are bent downwards. This configuration results in lamp 20 evenly illuminating an area of the adjacent sign face that is longer than the length of the lamp 20.

Two lamps 20 installed in a conventional "EXIT" sign will brightly and evenly illuminate the entire translucent portion of the sign, even if that portion is much wider and longer than the width and length of the lamps 20.

The lamp base 28 threads into a standard electrical lamp socket inside the "EXIT" sign to make the electrical connection. Lamp 20 can be made with common lamp bases such as intermediate, medium, candelabra or double contact bayonet bases, Alternately, lamp 20 can be made with only the candelabra base, but can also be used with converters from candelabra base to intermediate, medium and double contact bayonet bases.

Figure 4A:
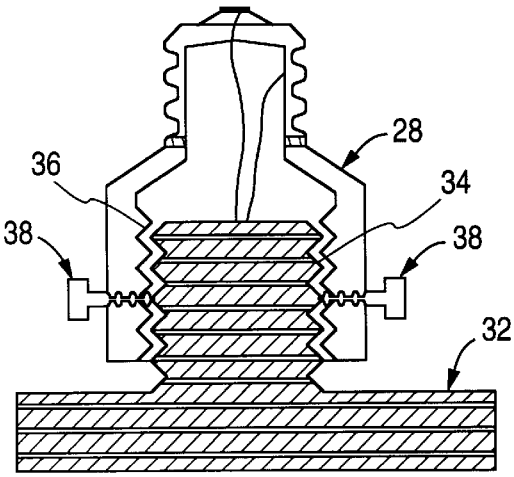
FIG. 4A is a cross-sectional side view of the interconnection between the lamp frame and the lamp base.

After lamp 20 has been fully threaded into the sign's lamp socket, angular adjustment of the lamp 20 will probably be necessary to ensure the LED arrays 22 properly face the adjacent sign face. The lamp base 28 therefore rotatably attaches to the lamp frame 26, as illustrated in FIG. 4A. Frame 26 terminates in a frame base portion 32 having a protruding threaded portion 34. Lamp base 28 is hollow with internal threads 36 that engage threads 34 such that frame base 32 freely rotates relative to lamp base 28. Set screws inserted through the lamp base threads 36 engage threaded portion 34 to restrict the free rotation of frame base 32 relative to lamp base 28. To install the lamp 20 into an "EXIT" sign, the set screws are tightened so that lamp base 28 can be fully threaded into the socket of the "EXIT" sign. The set screws 38 are then loosened for the angular adjustment of the lamp 20 by rotation of the frame base 32 relative to the lamp base 28. Once the frame 26 is in the desired angular position, set screws 38 are tightened to hold the frame 26 in position.

Figure 4B:
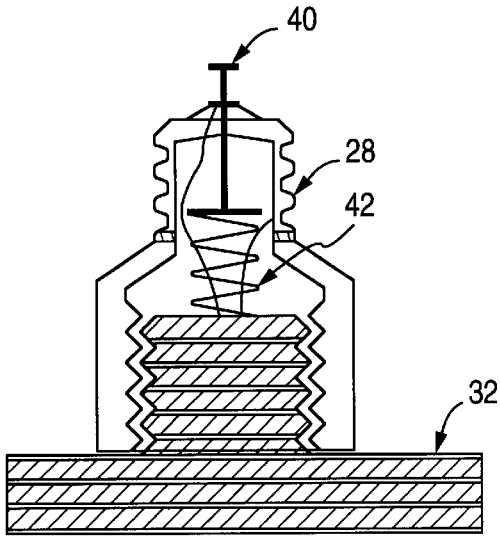
FIG. 4B is a cross-sectional side view of an alternate embodiment of the interconnection between the lamp frame and the lamp base.
Figure 4C:
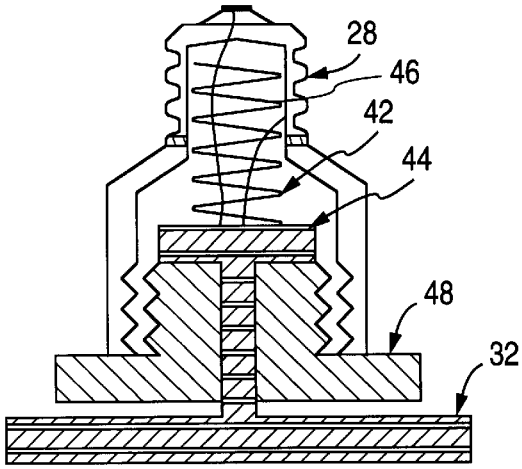
FIG. 4C is a cross-sectional side view of a second alternate embodiment of the interconnection between the lamp frame and the lamp base.
Figure 4D:
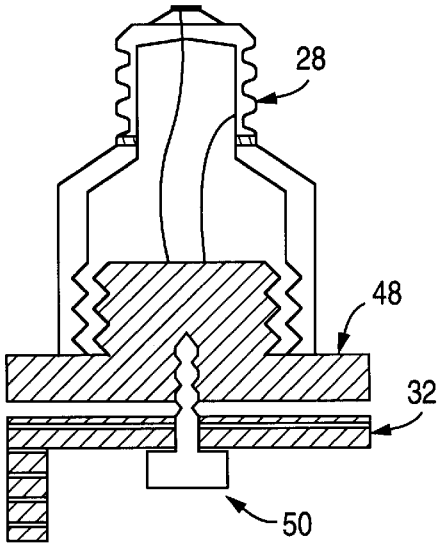
FIG. 4D is a cross-sectional side view of a third alternate embodiment of the interconnection between the lamp frame and the lamp base.

FIGS. 4B–4D illustrate alternate embodiments for attaching frame 26 to lamp base 28 for proper angular alignment of lamp 20 in the socket of the "EXIT" sign. In the embodiment of FIG. 4B, lamp base 28 and frame base 32 are fixed together so that they do not rotate relative to each other. The center electrode 40 is spring loaded by spring 42 for making electrical contact with the socket well before the lamp base 28 is fully threaded into the lamp socket. Therefore, after threading lamp base 28 mostly into the sign's lamp socket, the proper angular orientation of the lamp 20 can be achieved without having to completely tighten the lamp into the lamp socket.

In FIG. 4C, frame base 32 is attached or formed with a T-shaped piece 44, which is biased downward by spring 46 and held in position by threaded piece 48 fixed to lamp base 28. After the lamp base 28 has been threaded into the lamp socket, frame base 32 can be rotated with nominal torque relative to lamp base 28, with spring 42 holding frame base 32 in position once lamp 20 is oriented into its desired position.

FIG. 4D illustrates threaded piece 48 being fixed to lamp base 28. Set screw 50 attaches frame base 32 to threaded piece 48. Set screw 50 can be loosened to position the frame 26 into its desired angular position, and then tightened to secure that angular position.

Alternate embodiments of the lamp 20 will now be described.

Figure 5A:
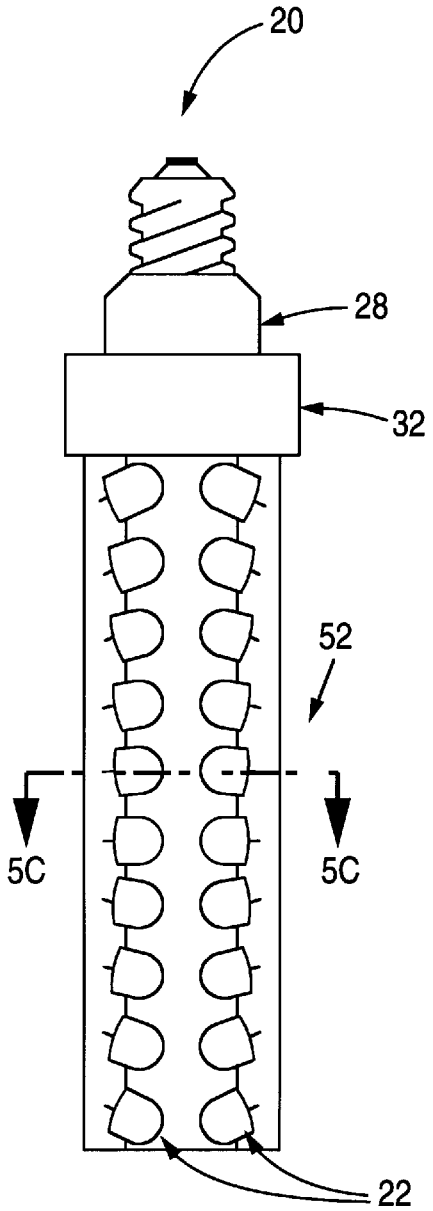
FIG. 5A is a front view of an alternate embodiment of the LED retrofit lamp of the present invention.
Figure 5B:
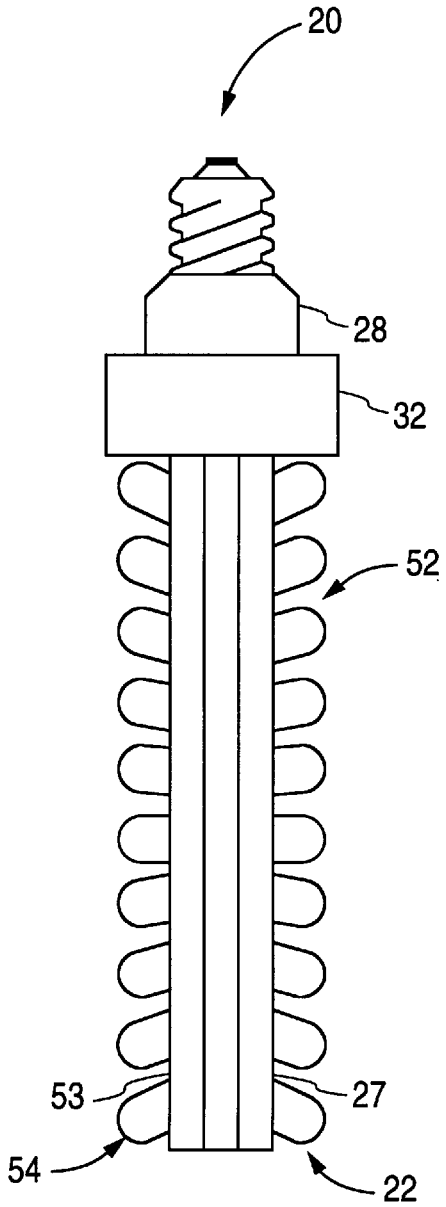
FIG. 5B is a side view of the alternate embodiment of the LED retrofit lamp of the present invention.
Figure 5C:
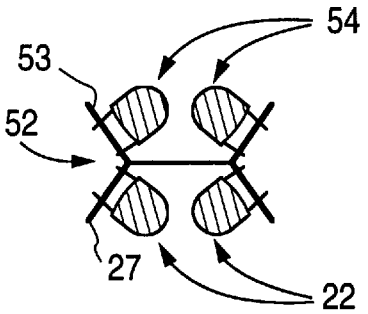
FIG. 5C is a top cross-sectional view of the alternate embodiment of the LED retrofit lamp of the present invention.

FIGS. 5A–C illustrate a first alternate embodiment of lamp 20, which is a double faced version of the embodiment illustrated in FIGS. 3A–C. A doubled faced frame 52 forms a U-shaped front face 27 and a U-shaped back face 53. Partially facing first pair of LED arrays 22 are mounted on the front face 27, and a second pair of partially facing LED arrays 54 are mounted on the rear face 53. The front/back faces 27/53 may be formed from, or coated with, a reflective material. This first alternate embodiment is ideal for "EXIT" signs that have two opposing faces with translucent portions on each opposing face. The double faced lamp is internally mounted between the sign faces to brightly and evenly illuminate both opposing faces of the "EXIT" sign, with front face 27 aligned towards one face of the sign and rear face 53 aligned toward the other face of the sign.

Figure 6A:
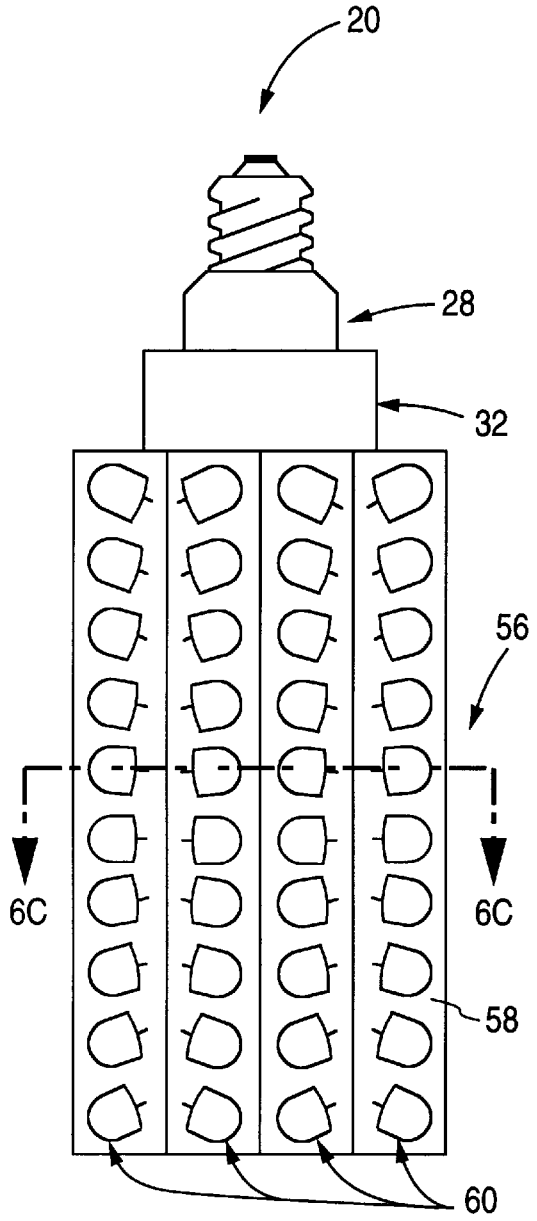
FIG. 6A is a front view of a second alternate embodiment of the LED retrofit lamp of the present invention.
Figure 6B:
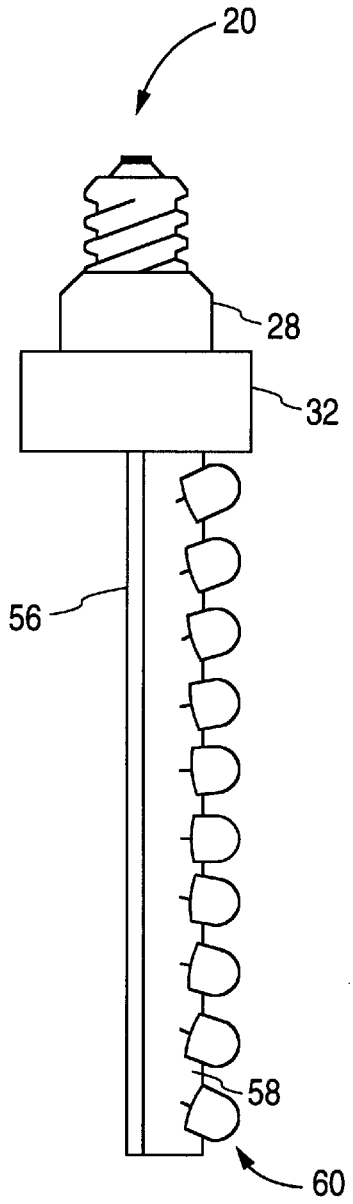
FIG. 6B is a side view of the second alternate embodiment of the LED retrofit lamp of the present invention.
Figure 6C:
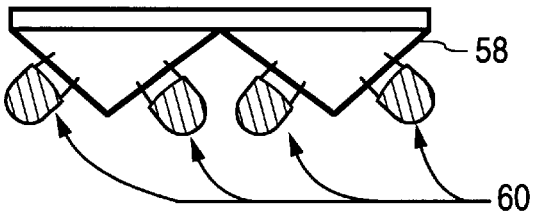
FIG. 6C is a top cross-sectional view of the second alternate embodiment of the LED retrofit lamp of the present invention.

FIGS. 6A–C illustrate a second alternate embodiment of lamp 20. The lamp frame 56 of this embodiment forms a W-shaped front face 58 upon which four linear arrays 60 of LEDs are mounted. The inner two arrays 60 partially face towards each other, and the outer two arrays 60 partially face away from each other. The W-shape of the front face 58 orients the LED arrays 60 to project light toward a single face of the "EXIT" sign to brightly and evenly illuminate that sign face. This second alternate embodiment of lamp 20 increases the amount of uniform light impinging the sign face, which is ideal for those sign applications requiring increased luminosity. Further, by using four LED arrays, lower output LEDs, such as the relatively low output level green LEDs, can be used to negate the need for a green filter on the translucent portions of those "EXIT" signs that require a green light output.

Figure 7A:
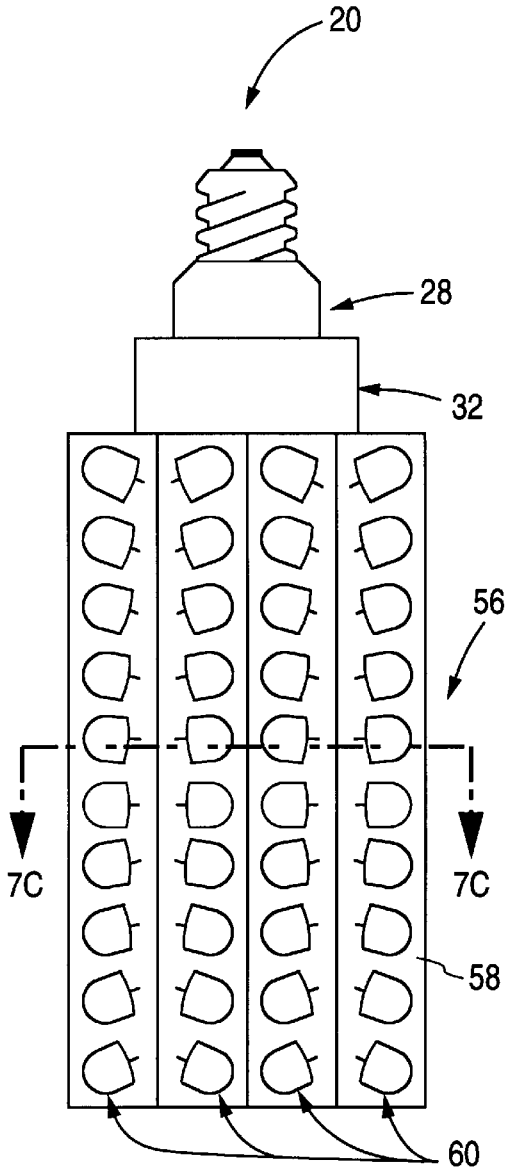
FIG. 7A is a front view of a third alternate embodiment of the LED retrofit lamp of the present invention.
Figure 7B:
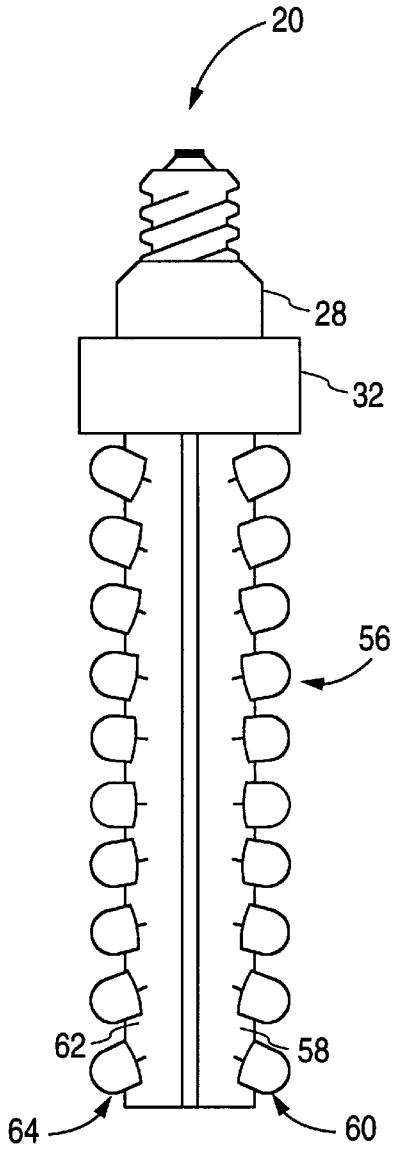
FIG. 7B is a side view of the third alternate embodiment of the LED retrofit lamp of the present invention.
Figure 7C:
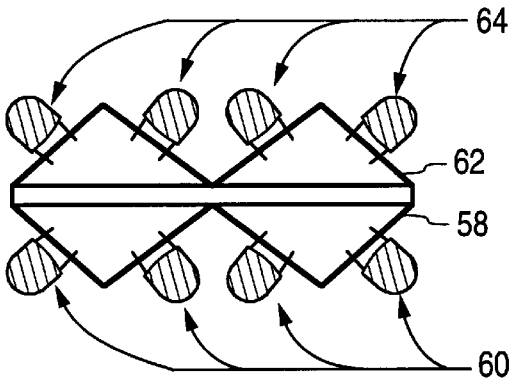
FIG. 7C is a top cross-sectional view of the third alternate embodiment of the LED retrofit lamp of the present invention.

FIGS. 7A–C illustrates a double faced version of the W-shaped face embodiment shown in FIGS. 6A–C. The lamp frame 56 forms a W-shaped back face 62 on the backside of W-shaped front face 58, upon which a second set of four LED arrays 64 are mounted. Front/rear faces 58/62 may be formed from, or coated with, a reflective material. This embodiment brightly and evenly illuminates two opposing faces of the "EXIT" sign with a total of 8 linear arrays of LEDs.

Figure 8A:
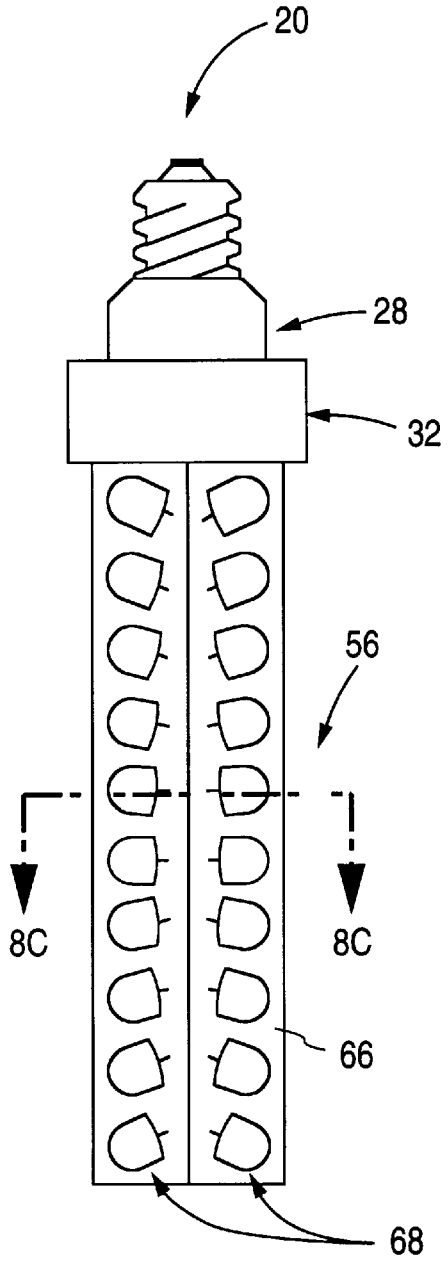
FIG. 8A is a front view of a fourth alternate embodiment of the LED retrofit lamp of the present invention.
Figure 8B:
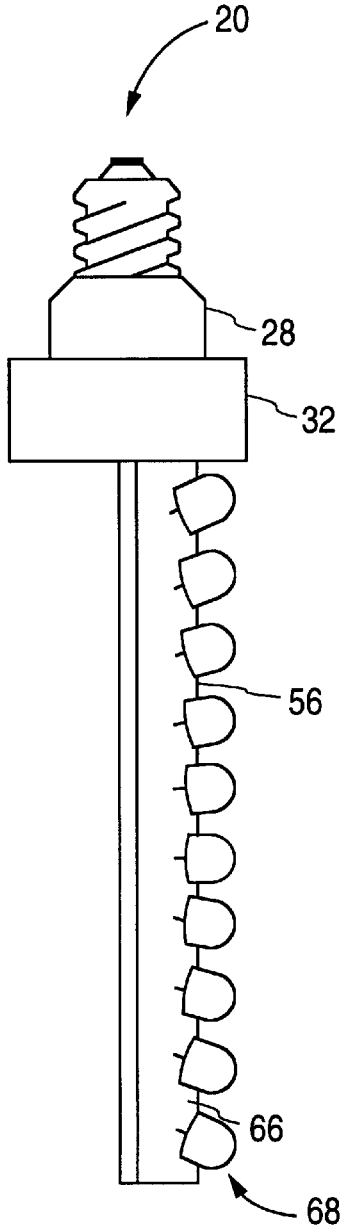
FIG. 8B is a side view of the fourth alternate embodiment of the LED retrofit lamp of the present invention.
Figure 8C:
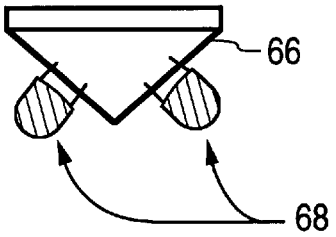
FIG. 8C is a top cross-sectional view of the fourth alternate embodiment of the LED retrofit lamp of the present invention.

FIGS. 8A–8C illustrate a lamp version similar to that shown in FIGS. 6A–6C, except the lamp only has half the W-shaped front face 58, thus resulting in a V-shaped front face 66, with a pair of linear arrays of LEDs 68 mounted thereon that partially face away from each other.

Figure 9A:
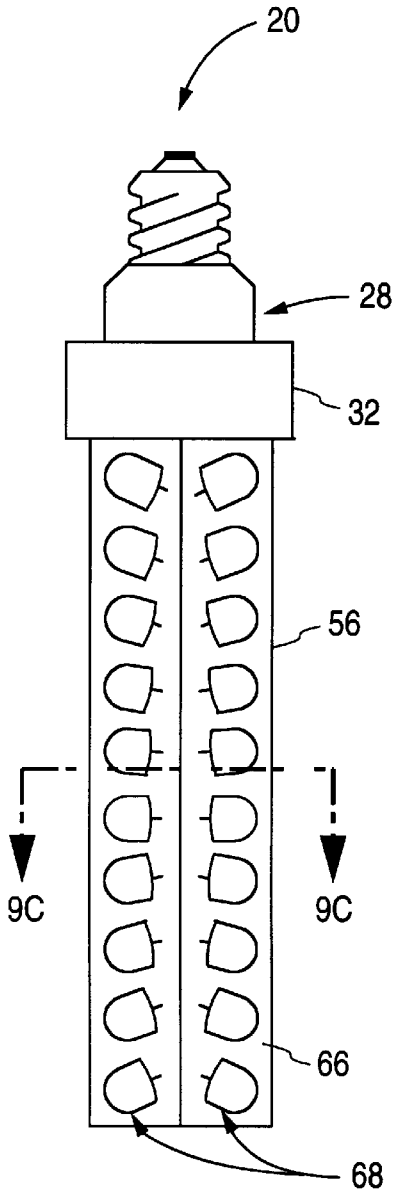
FIG. 9A is a front view of a fifth alternate embodiment of the LED retrofit lamp of the present invention.
Figure 9B:
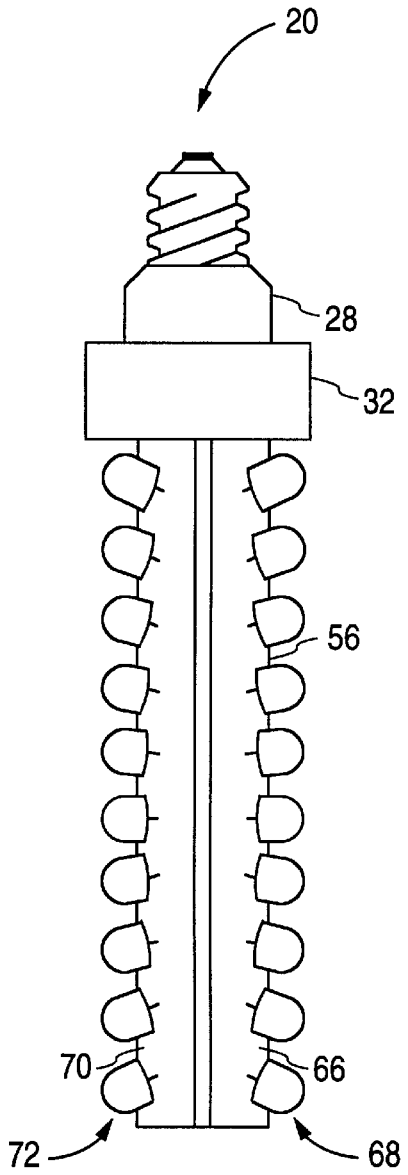
FIG. 9B is a side view of the fifth alternate embodiment of the LED retrofit lamp of the present invention.
Figure 9C:
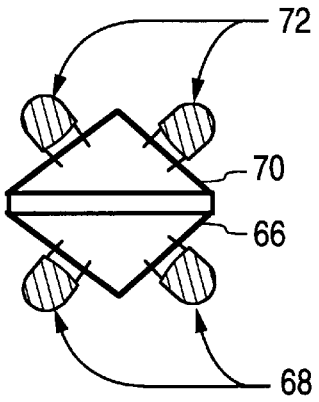
FIG. 9C is a top cross-sectional view of the fifth alternate embodiment of the LED retrofit lamp of the present invention.
Figure 10A:
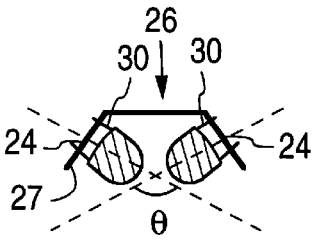
FIGS. 10A–10F are top cross-section views of the different alternate embodiments of the LED retrofit lamp illustrating the angle of orientation of the linear arrays.
Figure 10B:
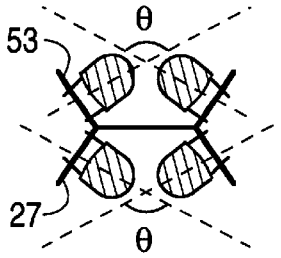
Figure 10C:
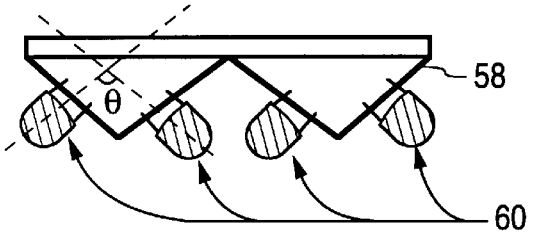
Figure 10D:
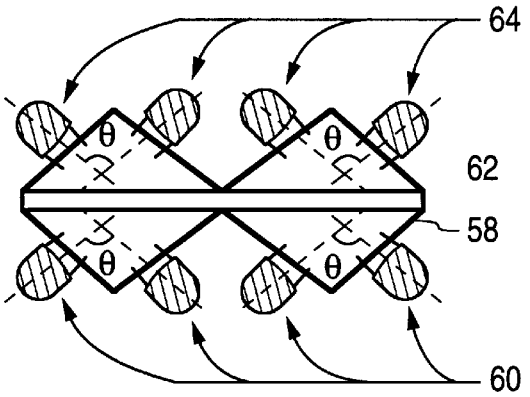
Figure 10E:
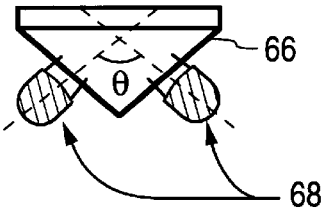
Figure 10F:
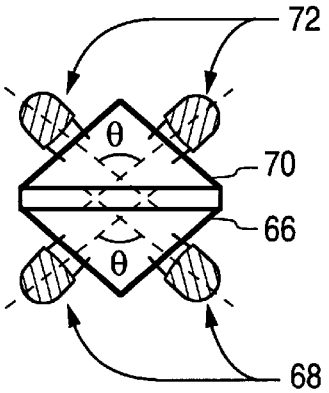

FIGS. 9A–9C illustrate a lamp version similar to that shown in FIGS. 8A–8C, but with a V-shaped back face 70 with a pair of linear arrays of LEDs 72 mounted thereon.

FIGS. 10A–10F illustrate the various orientations of the LED lamps as discussed above. Each pair of linear LED arrays in each of these lamp orientations implicitly has an angle of orientation θ between the directions in which the LED's face. This angle of orientation θ can be set to maximize uniform illumination, and to minimize hot spots, depending upon the particular LED lamp orientation used, the dimensions of the illuminated "EXIT" sign, what portions of the sign face(s) are translucent portions requiring illumination, the output level of the LED's, etc. In fact, for those embodiments with 2 or more pairs of linear LED arrays, the angle of orientation θ for one pair of linear LED arrays can be different than for another pair of linear arrays mounted in the same lamp 20. Additionally, a lamp with 2 or more pairs of linear LED arrays can be totally non-symmetric, with different angles of orientation θ, and with no LED array facing in a direction parallel to the facing direction of another LED array.

Figure 11A:
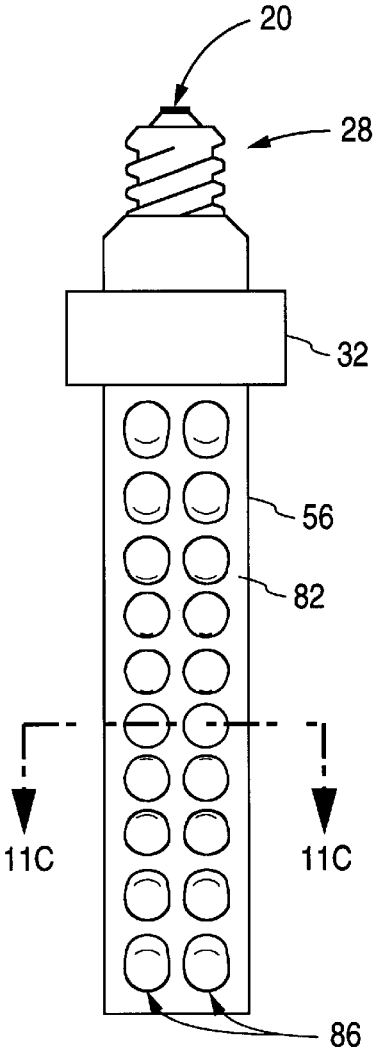
FIG. 11A is a front view of a sixth alternate embodiment of the LED retrofit lamp of the present invention.
Figure 11B:
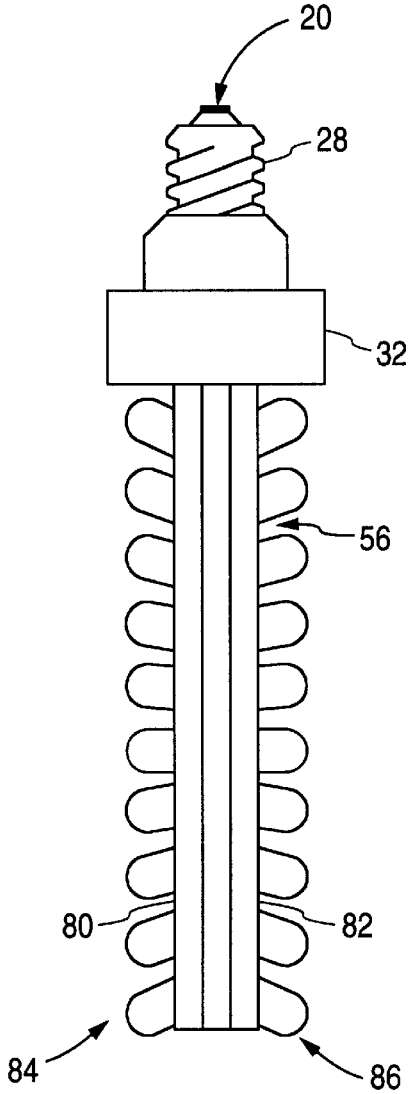
FIG. 11B is a side view of the sixth alternate embodiment of the LED retrofit lamp of the present invention.
Figure 11C:
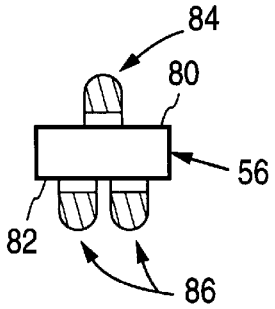
FIG. 11C is a top cross-sectional view of the sixth alternate embodiment of the LED retrofit lamp of the present invention.
Figure 11D:
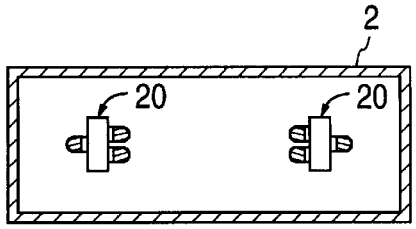
FIG. 11D is a top cross-sectional view of another version of the sixth alternate embodiment of the LED retrofit lamp of the present invention.
Figure 11E:
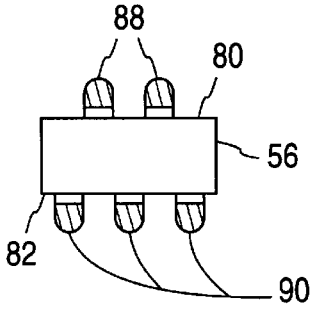
FIG. 11E is a top cross-sectional view of another version of the sixth alternate embodiment of the LED retrofit lamp of the present invention.

FIGS. 11A–11D illustrate a sixth alternate embodiment of lamp 20. The lamp frame 56 of this embodiment forms two substantially parallel faces 80 and 82. A single linear LED array 84 is mounted on the face 80, and a double linear LED array 86 is mounted on the face 82. The lamps 20 can be oriented inside the "EXIT" sign 2 as shown in FIG. 11D to direct the light from the double linear LED arrays 86 towards the center of the "EXIT" sign, which requires more light for uniform illumination, and to direct the light from the single linear LED arrays 84 towards the ends of the "EXIT" sign, which requires less light for uniform illumination. Reflections off of the non-translucent interior sides of the "EXIT" sign will help provide uniform illumination over both faces of the "EXIT" sign. It should be noted that additional linear LED arrays can be added to each of the faces 80 and 82, depending upon the illumination requirements of the "EXIT" sign being illuminated. For example, as shown in FIG. 11E, a double linear LED array 88 is mounted on face 80, and a triple linear LED array 90 is mounted on face 82. By adding additional LED arrays, the length of the LED arrays, and therefore the overall lamp length, can be reduced without reducing the overall luminosity of the lamp. Shorter lamps fit better into smaller "EXIT" signs.

It should be evident from the above description that the retrofit lamps of the present invention are also ideal for newly manufactured illuminated signs of all types.

It is to be understood that the present invention is not limited to the embodiments described above and illustrated herein, but encompasses any and all variations falling within the scope of the appended claims.

What is claimed is:

1. An LED lamp, comprising:

a lamp base;

an elongated lamp frame having a longitudinal axis and a front face; and first and second linear arrays of light emitting diodes mounted on the front face and extending substantially parallel to the longitudinal axis, the first and second linear arrays are mounted to partially face toward each other.

2. The LED lamp of claim 1, wherein the front face has a U-shaped cross-section.

3. The LED lamp of claim 2, wherein the elongated lamp frame further comprises:

a rear face having a U-shaped cross-section; and third and fourth linear arrays of light emitting diodes mounted on the rear face and extending substantially parallel to the longitudinal axis, the third and fourth linear arrays are mounted to partially face toward each other.

4. The LED lamp of claim 1, wherein the lamp base includes a threaded portion for connection into a threaded electrical socket, and a spring loaded center electrode.

5. The LED lamp of claim 1, wherein the lamp base and the lamp frame are rotatably connected to each other.

6. The LED lamp of claim 5, further comprising:

a set screw that fixes an angular orientation of the lamp base relative to the lamp frame, wherein the rotatable connection between the lamp base and the lamp frame includes a first set of threads formed on the lamp base that engage a second set of threads formed on the lamp frame.

7. An LED lamp, comprising:

a lamp base;

an elongated lamp frame having a longitudinal axis, a front face having a V-shaped cross-section, and a rear face having a V-shaped cross-section;

first and second linear arrays of light emitting diodes mounted on the front face and extending substantially parallel to the longitudinal axis, the first and second linear arrays are mounted to partially face away from each other; and third and fourth linear arrays of light emitting diodes mounted on the rear face and extending substantially parallel to the longitudinal axis, the third and fourth linear arrays are mounted to partially face away from each other.

8. An LED lamp, comprising:

a lamp base;

an elongated lamp frame having a longitudinal axis and a front face;

first and second linear arrays of light emitting diodes mounted on the front face and extending substantially parallel to the longitudinal axis, the first and second linear arrays are mounted to partially face toward each other; and third and fourth linear arrays of light emitting diodes mounted on the front face and extending substantially parallel to the longitudinal axis, wherein the front face has a W-shaped cross-section such that the first and second linear arrays partially face toward each other and the third and fourth linear arrays partially face away from each other.

9. The LED lamp of claim 8, wherein the elongated lamp frame further comprises:

a rear face having a W-shaped cross-section; and a plurality of linear arrays of light emitting diodes each mounted on the rear face and extending substantially parallel to the longitudinal axis, wherein at least two of the plurality of linear arrays are mounted to partially face toward each other, and at least two other of the plurality of linear arrays are mounted to partially face away from each other.

10. An LED lamp, comprising:

a lamp base;

an elongated lamp frame having a longitudinal axis and a front face;

first and second linear arrays of light emitting diodes mounted on the front face and extending substantially parallel to the longitudinal axis, the first and second linear arrays are mounted to partially face toward or partially face away from each other;

at least one of the light emitting diodes from each of the first and second linear arrays are oriented to point in a direction toward the lamp base; and at least another one of the light emitting diodes from each of the first and second linear arrays are oriented to point in a direction away from the lamp base.

11. An illuminated sign, comprising:

a housing with a front display panel that has a first translucent indicia portion;

an LED lamp disposed adjacent the front display panel, the LED lamp including:

a lamp base, an elongated lamp frame having a longitudinal axis and a front face, and first and second linear arrays of light emitting diodes mounted on the front face and extending substantially parallel to the longitudinal axis, the first and second linear arrays produce a first light output and are mounted to partially face toward each other;

wherein the first and second linear arrays project a majority of the first light output onto the front display panel at non-perpendicular angles relative to the front display panel.

12. The illuminated sign of claim 11, wherein the front face has a U-shaped cross-section.

13. The illuminated sign of claim 12, wherein:

the housing further includes a rear display panel having a second translucent indicia and opposing the front display panel, the LED lamp is disposed between the front and rear display panels; and the elongated lamp frame further comprises:

a rear face having a U-shaped cross-section; and third and fourth linear arrays of light emitting diodes mounted on the rear face and extending substantially parallel to the longitudinal axis, the third and fourth linear arrays produce a second light output and are mounted to partially face toward each other so that the third and fourth linear arrays project a majority of the second light output onto the rear display panel at non-perpendicular angles relative to the rear display panel.

14. The illuminated sign of claim 11, wherein the LED lamp is oriented to evenly illuminate a portion of the front display panel that is wider than a width of the front face.

15. The illuminated sign of claim 11, wherein the lamp base includes a threaded portion for connection into a threaded electrical socket, and a spring loaded center electrode.

16. The illuminated sign of claim 11, wherein the lamp base and the lamp frame are rotatably connected to each other.

17. The illuminated sign of claim 16, further comprising:

a set screw that fixes an angular orientation of the lamp base relative to the lamp frame, wherein the rotatable connection between the lamp base and the lamp frame includes a first set of threads formed on the lamp base that engage a second set of threads formed on the lamp frame.

18. An illuminated sign comprising:

a housing with a front display panel that has a first translucent indicia portion;

an LED lamp disposed adjacent the front display panel, the LED lamp including:

a lamp base, an elongated lamp frame having a longitudinal axis and a front face having a V-shaped cross-section, and first and second linear arrays of light emitting diodes mounted on the front face and extending substantially parallel to the longitudinal axis, the first and second linear arrays produce a first light output and are mounted to partially face away from each other, wherein the first and second linear arrays project a majority of the first light output onto the front display panel at non-perpendicular angles relative to the front display panel;

the housing further includes a rear display panel having a second translucent indicia and opposing the front display panel, the LED lamp is disposed between the front and rear display panels; and the elongated lamp frame further comprises:

a rear face having a V-shaped cross-section; and third and fourth linear arrays of light emitting diodes mounted on the rear face and extending substantially parallel to the longitudinal axis, the third and fourth linear arrays produce a second light output and are mounted to partially face away from each other so that the third and fourth linear arrays project a majority of the second light output onto the rear display panel at non-perpendicular angles relative to the rear display panel.

19. An illuminated sign, comprising:

a housing with a front display panel that has a first translucent indicia portion;

an LED lamp disposed adjacent the front display panel, the LED lamp including:

a lamp base, an elongated lamp frame having a longitudinal axis and a front face, and first and second linear arrays of light emitting diodes mounted on the front face and extending substantially parallel to the longitudinal axis, the first and second linear arrays produce a first light output and are mounted to partially face toward each other, wherein the first and second linear arrays project a majority of the first light output onto the front display panel at non-perpendicular angles relative to the front display panel, and third and fourth linear arrays of light emitting diodes mounted on the front face and extending substantially parallel to the longitudinal axis, wherein the front face has a W-shaped cross-section such that the first and second linear arrays partially face toward each other and the third and fourth linear arrays partially face away from each other, and wherein the third and fourth linear arrays produce a second light output and project a majority of the second light output onto the front display panel at non-perpendicular angles relative to the front display panel.

20. The illuminated sign of claim 19, wherein:

the housing further includes a rear display panel having a second translucent indicia and opposing the front display panel, the LED lamp is disposed between the front and rear display panels; and the elongated lamp frame further comprises:

a rear face having a W-shaped cross-section; and a plurality of linear arrays of light emitting diodes that produce a third light output and each are mounted on the rear face and extending substantially parallel to the longitudinal axis, wherein at least two of the plurality of linear arrays are mounted to partially face toward each other, and at least two other of the plurality of linear arrays are mounted to partially face away from each other, such that the plurality of linear arrays project a majority of the third light output onto the rear display panel at non-perpendicular angles relative to the rear display panel.

21. An illuminated sign, comprising:

a housing with a front display panel that has a first translucent indicia portion;

an LED lamp disposed adjacent the front display panel, the LED lamp including:

a lamp base, an elongated lamp frame having a longitudinal axis and a front face, and first and second linear arrays of light emitting diodes mounted on the front face and extending substantially parallel to the longitudinal axis, the first and second linear arrays produce a first light output and are mounted to partially face toward or partially face away from each other, wherein the first and second linear arrays project a majority of the first light output onto the front display panel at non-perpendicular angles relative to the front display panel;

at least one of the light emitting diodes from each of the first and second linear arrays are oriented to point in a direction toward the lamp base, and at least another one of the light emitting diodes from each of the first and second linear arrays are oriented to point in a direction away from the lamp base, such that the first light output projected by the first and second linear arrays evenly illuminates a portion of the front display panel that is longer than a length of the first and second linear arrays.

22. An illuminated sign, comprising:

a housing with a front display panel that has a first translucent indicia portion and a rear display panel that has a second translucent indicia; and a first LED lamp disposed between the front and rear display panels, the first LED lamp including:

a lamp base, an elongated lamp frame having a longitudinal axis and planar front and rear faces that are substantially parallel to each other, at least one linear array of light emitting diodes producing a first light output and mounted on the front face and extending substantially parallel to the longitudinal axis, and a plurality of linear arrays of light emitting diodes producing a second light output that is greater than the first light output and mounted on the rear face and extending substantially parallel to the longitudinal axis;

wherein the first LED lamp is disposed away from a center position of the housing and oriented with the rear face facing toward the center position of the housing and the front face facing away from the center position of the housing so that the first and second light outputs are projected onto the front and rear display panels at non-perpendicular angles relative to the front and rear display panels.

23. The illuminated sign of claim 22, further comprising:

a second LED lamp disposed between the front and rear display panels, the second LED lamp including:

a lamp base, an elongated lamp frame having a longitudinal axis and planar front and rear faces that are substantially parallel to each other, at least one linear array of light emitting diodes producing a first light output and mounted on the front face and extending substantially parallel to the longitudinal axis, and a plurality of linear arrays of light emitting diodes producing a second light output that is greater than the first light output and mounted on the rear face and extending substantially parallel to the longitudinal axis;

wherein the second LED lamp is disposed on an opposite side of the housing center position as is the first LED lamp and oriented with its rear face facing the housing center position and the rear face of the first LED lamp so that the first and second light outputs from the second LED lamp are projected onto the front and rear display panels at non-perpendicular angles relative to the front and rear display panels.

* * * * *